US007608026B1

(12) United States Patent
Nicassio

(10) Patent No.: US 7,608,026 B1
(45) Date of Patent: Oct. 27, 2009

(54) DEVICE FOR STRENGTHENING, TRAINING, AND REHABILITATING ISOLATED MUSCLE GROUPS USING ELASTIC RESISTANCE ELEMENTS

(76) Inventor: Jesse Nicassio, 6505 Smoketree Ave., Oak Park, CA (US) 91377

( * ) Notice: Subject to any disclaimer, the term of this patent is extended or adjusted under 35 U.S.C. 154(b) by 22 days.

(21) Appl. No.: 12/069,317

(22) Filed: Feb. 8, 2008

(51) Int. Cl.
*A63B 21/02* (2006.01)

(52) U.S. Cl. ..... 482/124; 482/121; 24/625; 24/265 BC; 24/300; 24/301

(58) Field of Classification Search ..... 482/10, 482/44, 47, 69, 121, 122, 123, 124, 125, 482/126; 601/23, 33; 119/857; 182/3–6; 2/69, 112, 230, 249, 250; 473/208–217, 473/274–277; 403/326, 329, 397; 24/614, 24/615, 625, 265 BC, 265 H, 265 R, 265 EE, 24/265 EC, 300, 301
See application file for complete search history.

(56) References Cited

U.S. PATENT DOCUMENTS 3,162,441 A * 12/1964 Karlik ..... 482/124
3,162,442 A * 12/1964 Karlik ..... 482/124
3,411,500 A * 11/1968 Gatts ..... 600/20
5,033,117 A 7/1991 Fairweather ..... 2/69
5,080,191 A * 1/1992 Sanchez ..... 182/3
5,148,582 A * 9/1992 Dennis, Jr. ..... 24/625
5,188,365 A * 2/1993 Picard ..... 473/213
5,203,754 A * 4/1993 Maclean ..... 482/124
5,222,279 A * 6/1993 Frano et al. ..... 24/625
5,306,222 A * 4/1994 Wilkinson ..... 482/124
5,308,305 A * 5/1994 Romney ..... 482/124
5,518,480 A * 5/1996 Frappier ..... 482/124
5,546,639 A * 8/1996 Lacore et al. ..... 24/265 H
5,588,941 A 12/1996 Scott ..... 482/131
5,590,444 A * 1/1997 Krauss ..... 24/625
5,647,827 A * 7/1997 Gutkowski et al. ..... 482/124
5,683,336 A * 11/1997 Pape ..... 482/124
5,737,810 A * 4/1998 Krauss ..... 24/625
5,813,955 A 9/1998 Gutkowski et al. ..... 482/124
5,993,362 A * 11/1999 Ghobadi ..... 482/124
6,099,446 A 8/2000 Johnson et al. ..... 482/124
6,213,922 B1 4/2001 Afanasenko et al. ..... 482/124
6,226,844 B1 * 5/2001 Lerra et al. ..... 24/625
6,651,594 B1 * 11/2003 Bagwell ..... 119/770
6,659,921 B2 12/2003 Vernon ..... 482/124
6,752,776 B2 * 6/2004 West ..... 602/36
6,840,894 B2 1/2005 Lerner ..... 482/124
6,942,630 B2 * 9/2005 Behan ..... 602/19
7,004,892 B2 * 2/2006 Marco ..... 482/124
D518,535 S * 4/2006 Haskell ..... D21/662
7,153,246 B2 * 12/2006 Koscielny et al. ..... 482/121
2001/0007845 A1 * 7/2001 Afanasenko et al. ..... 482/124

(Continued)

*Primary Examiner*—Loan H Thanh
*Assistant Examiner*—Daniel F Roland
(74) *Attorney, Agent, or Firm*—Goldstein Law Offices PC.

(57) ABSTRACT

An exercise device, for use in strengthening, training, and rehabilitating the body, using at least two harnesses and at least one elastic element. The harnesses are attached to the body and have mating clips attached to them to establish anchor points. The elastic element has a pair of clip receptacle for attaching to the mating elements and has an elastic cord extending therebetween. When the clip receptacles are secured to the mating clips at a pair of anchor points, body movements relative to the anchor points are resisted by the elastic elements.

11 Claims, 14 Drawing Sheets

U.S. PATENT DOCUMENTS

2002/0068667 A1* 6/2002 Strachan ..... 482/124
2003/0092545 A1* 5/2003 Koscielny et al. ..... 482/124
2005/0176562 A1* 8/2005 Huang ..... 482/121
2005/0282689 A1* 12/2005 Weinstein ..... 482/124
2006/0053600 A1* 3/2006 Liu ..... 24/615
2006/0229175 A1* 10/2006 Frappier ..... 482/124
2007/0004570 A1* 1/2007 Afanasenko et al. ..... 482/124
2007/0004571 A1* 1/2007 Gonzalez ..... 482/124
2007/0015641 A1* 1/2007 Demeniuk ..... 482/124
2007/0015642 A1 1/2007 Demeniuk ..... 482/124
2007/0135278 A1* 6/2007 Grigoriev et al. ..... 482/124
2008/0287840 A1* 11/2008 Koscielny et al. ..... 601/23

* cited by examiner

DEVICE FOR STRENGTHENING, TRAINING, AND REHABILITATING ISOLATED MUSCLE GROUPS USING ELASTIC RESISTANCE ELEMENTS

BACKGROUND OF THE INVENTION

The invention relates to a device for strengthening, training, and rehabilitating isolated muscle groups. More particularly, the invention relates to a device that employs elastic resistance elements that are connected between parts of the body to resist movement and thereby aid in the strengthening, training, and rehabilitation of select muscle groups.

It is well known that muscles develop, tone, and strengthen through use. In particular, repeated and regular use of a muscle is not only important for its development, but also necessary to prevent it from atrophying and weakening.

Various types of exercises, activities, and devices have are known for the purpose of assisting and facilitating muscle development. Most of these are well suited for a single purpose, such as strength training, or speed training, or toning, or rehabilitating.

What is needed is a device that is well suited for achieving multiple exercise goals. This device should not only be useful for rehabilitating muscles—such as following an injury—but also should also be useful for training muscles for strength and agility, either for general fitness or to facilitate mastering a particular sporting activity.

U.S. Pat. No. 5,813,955 to Gutkowski et al. discloses an aerobic exercise device that uses elastic hand and foot resistance members. Gutkowski, however fails to provide significant variation as it only attached between the extremities and waist, and uses simple hooks which are bound to fail, possibly causing injury.

United States Patent Publication No. 2007/0015642 by Demeniuk discloses a body vest gym. Demeniuk, however, employs elastic bands that are positioned alongside the body. Accordingly, Demeniuk is limited in the type of motions and body movements it can be configured to resist. Demeniuk is therefore limited in its ability to train, strengthen, and rehabilitate the body.

While these units may be suitable for the particular purpose employed, or for general use, they would not be as suitable for the purposes of the present invention as disclosed hereafter.

SUMMARY OF THE INVENTION

It is an object of the invention to produce an exercise device that is well suited for muscle development in various forms. Accordingly the present invention employs elastic elements which, when used in accordance with the principles of the present invention, provide resistance against muscle movement suitable for achieving the desired fitness goals for that muscle.

It is a further object of the invention to provide an exercise device which may be used for muscle groups throughout the entire body. Accordingly, the present invention employs a variety of harnesses which facilitate attachment onto different parts of the body to allow different movements to be resisted using the elastic elements, and thereby allow the training of many different muscle groups.

It is another object of the invention to provide an exercise device that allows resistance to muscle movement to be easily varied. Accordingly, each elastic element has a clip assembly that allows it to be easily attached and detached from associated components, such that they can be quickly and easily interchanged with elastic elements having different elastic properties.

It is a further object of the invention to provide an exercise device that is reliable in construction. Accordingly, the clip assembly is configured for durability and strength so as to ensure performance and minimize failures.

The invention is an exercise device, for use in strengthening, training, and rehabilitating the body, using at least two harnesses and at least one elastic element. The harnesses are attached to the body and have mating clips attached to them to establish anchor points. The elastic element has a pair of clip receptacle for attaching to the mating elements and has an elastic cord extending therebetween. When the clip receptacles are secured to the mating clips at a pair of anchor points, body movements relative to the anchor points are resisted by the elastic elements.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
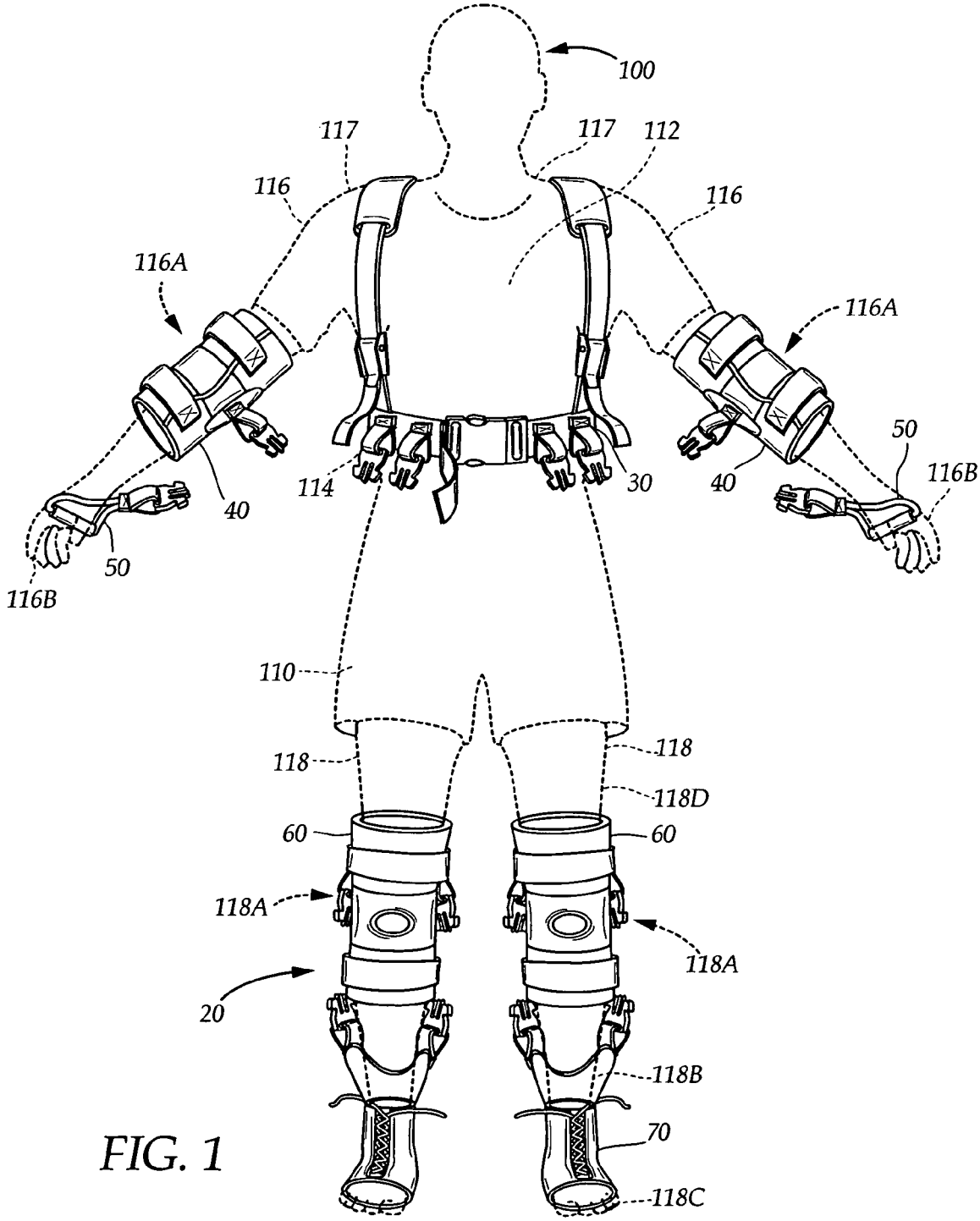
FIG. 1 is a front elevational view, illustrating the present invention, per se, attached on a user with the elastic elements removed for illustrative clarity.

FIG. 1 illustrates an exercise device 20 attached on a user 100, having a body 110. The body 110 includes a torso 112, a waist 114, a pair of arms 116, a pair of shoulders 117, and a pair of legs 118. The arms 116 each include an elbow 116A and a hand 116B. The legs 118 each include a knee 118A, a shin 118B, a foot 118C, and a thigh 118D. The exercise device 20 includes a core harness 30 which is located on the torso 112 between the waist 114 and shoulders 117; a pair of middle arm harnesses 40 which are located on the arms 116, substantially midway between the hand 116B and shoulder 117 at the elbow 116A; a pair of hand straps 50 located at the hands 116B; a pair of middle leg harnesses 60 located on the legs 118 substantially at, above, and below the knee 118A; and a pair of foot harnesses 70, located on foot 118C and shin 118B of each leg 118.

Figure 7:
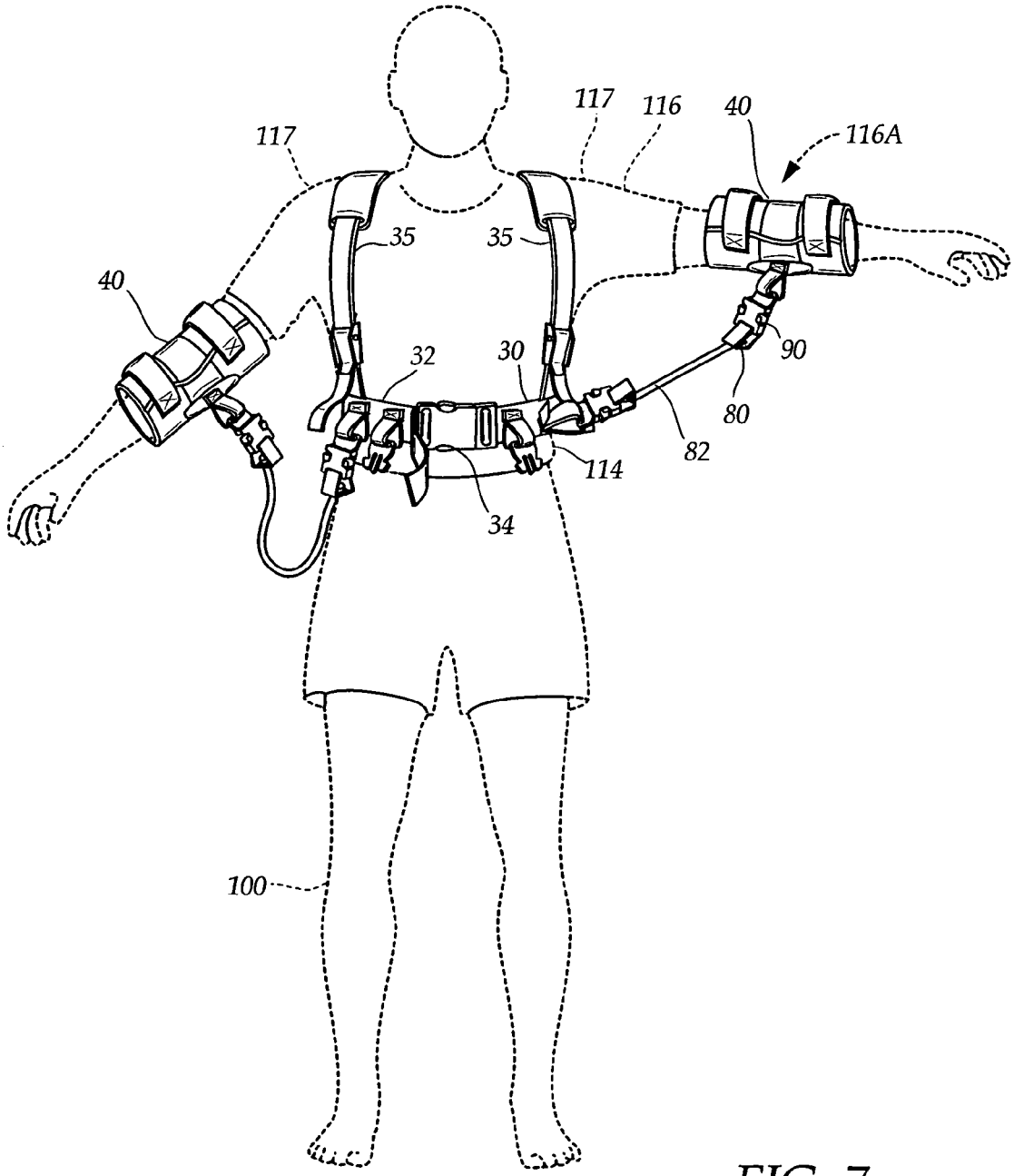
FIG. 7 is a front elevational view, illustrating—for each arm—one of the elastic elements attached between the middle arm assembly and the core harness.

As will be apparent and described in detail hereinafter, the harnesses and straps as previously described provide anchor points in accordance with the present invention. In furtherance of the principles of the present invention, FIG. 7 provides an example of how these anchor points are further utilized. Referring now to FIG. 7, the core harness 30 is connected to each of the middle arm harnesses 40 with an elastic element 80, which includes an elastic cord 82 having elastic properties. The elastic element allows a body movement of the user to be resisted according to the elastic properties of the elastic cord 82. In particular, in the example illustrated in FIG. 7, the movement being resisted is the lateral raising of the user's arm 116. To accomplish this, the elastic element 80 is anchored between a middle arm harness 40 which is located at the elbow 116A, and to the core harness 40 at the waist 114. The elastic element 80 is attached to each anchor point with a clip assembly 90. As will be further understood during the following description, the exercise device 20 can be configured in numerous ways, to resist numerous body movements, and thereby strengthen, train, and rehabilitate the body as desired.

In the following description, various components are described in detail. The primary purpose of these components is to provide anchor points for the elastic elements on the user's body, to allow the elastic elements to effectively resist the desired body movements, and isolate muscle groups for strengthening, training, and rehabilitating, as appropriate to the fitness goals and needs of the user.

Figure 6:
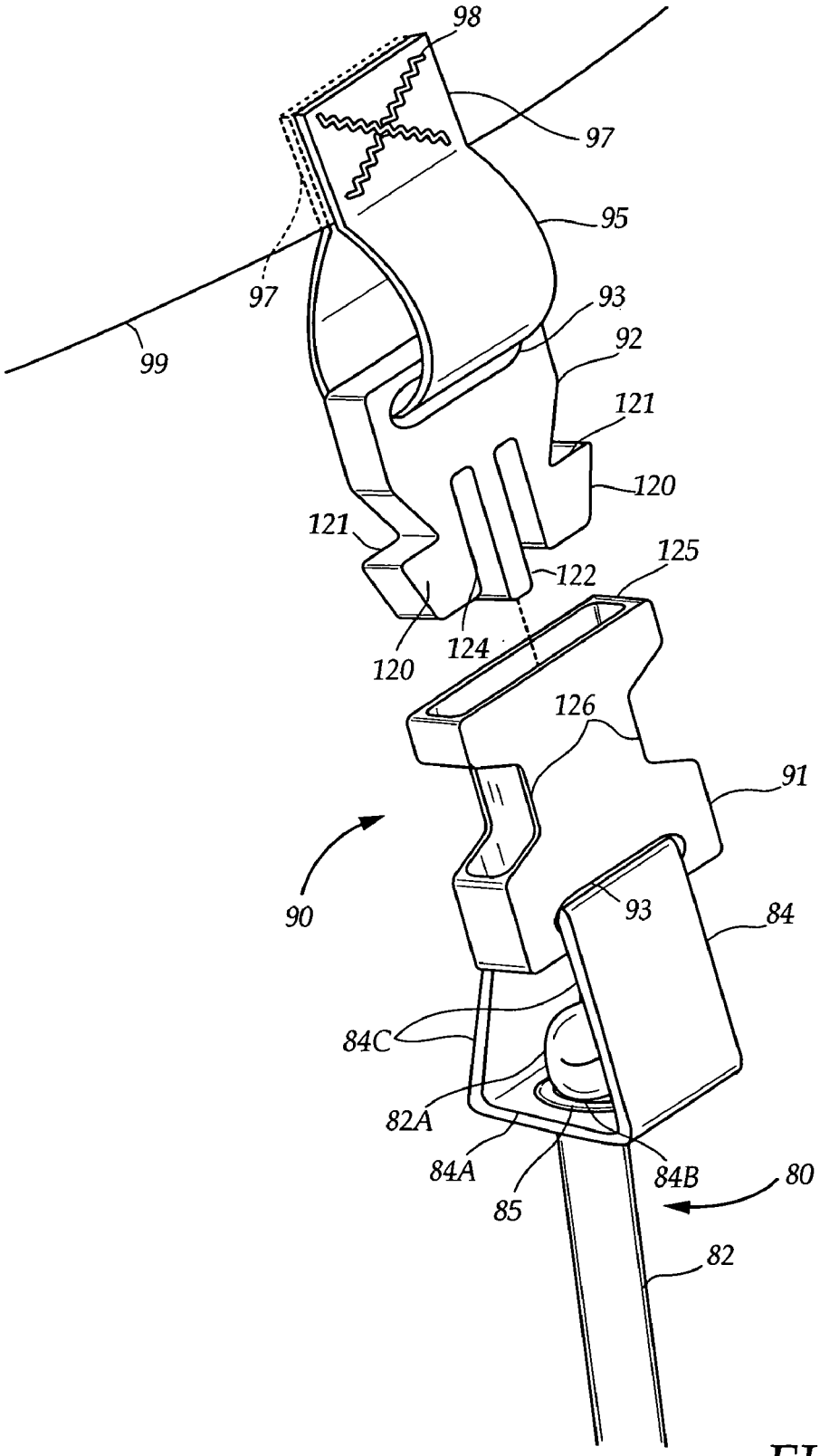
FIG. 6 is a diagrammatic perspective view, illustrating one of the elastic elements being attached to another part of the invention, using the clip assembly.

Referring to FIG. 6, each clip assembly 90 includes a clip receptacle 91 and a mating clip 92. Both the clip receptacle 91 and mating clip 92 have end slots 93 which facilitate attaching broad and flat straps and the like therethrough. The clip receptacle 91 is part of the elastic element 80 and is attached to the elastic cord 82.

The mating clip 92 includes a pair of side members 120 and a central member 122 located between the side members 120. The side members 120 have hooks 121 that protrude outwardly therefrom. A pair of longitudinal slots 124 are located between the side members 120 and the central member 122. The longitudinal slots 124 essentially provide space for the side members 120 to flex inwardly.

The clip receptacle 91 has a main opening 125, and a pair of side openings 126. The main opening is sized to substantially accept the mating clip 92 when the side members 120 are flexed inwardly toward each other. When the mating clip 92 is fully inserted into the clip receptacle, the side members 120 flex outwardly through the side openings 126, and the hooks 121 prevent the mating clip 92 from being withdrawn from the clip receptacle 91. Accordingly, the mating clip 92 is secured to the clip receptacle 91 and will resist substantial forces to pull them apart. Releasing the mating clip 92 from the clip receptacle 91 requires manually flexing the side members 120 inwardly while pulling the mating clip 92 away from the clip receptacle 91.

The elastic element 80 includes a connecting loop 84 having a base 84A, and a metal grommet 85 secured at the base 84A, and sides 84C. A circular hole 84B extends through both the grommet 85 and base 84A. The connecting loop 84 is preferably made of a strong nylon webbing material. The sides 84C extend through the end slot 93 of the clip receptacle 91 thereby securing the connecting belt 84 thereto and resisting force tending to pull the clip receptacle 91 and connecting loop 84 apart, beyond the limit of any force possible by human muscle. The base 84B, where the grommet is located is fully opposite from the end slot 93 on the connecting loop 84. The elastic cord 82 extends through the circular hole 84B, and is secured therein by an enlargement 82A which is larger than the circular hole 84B. The enlargement can be formed by a knot in the elastic cord 82, a molded structure of the elastic cord 82, or any other means known to those skilled in the field of the invention for preventing the elastic cord 82 from pulling through the circular hole 84B, and thereby allowing the elastic cord 82 to be tensioned in a direction perpendicular to base 84A and thus perpendicular to the circular hole 84B. This manner of connection, using the grommet 85, creates a very strong bond between the elastic cord 82 and clip receptacle 91.

Also illustrated in FIG. 6, an attaching band 95 extends through the end slot 93 of the mating clip 92 to secure the mating clip 92 to its associated strap or harness 99. The associated strap or harness can be the hand straps 50, core harness 30, middle arm harness 40, middle leg harness 60, foot harness 70, or any similar construction intended for creating an anchor point to which one of the elastic elements 80 is attached. The attaching band 95 is preferably made of a webbed nylon fabric having superior strength and rip resistance, of the type commonly used for seat belts and securing straps often used in back packs, vehicles, amusement park rides, etc. The attaching band has a pair of end tabs 97 at opposite ends, and is preferably secured to its associated strap or harness by securing the pair of end together, with the associated strap or harness sandwiched between the strap or harness, and stitching 98 extending through both end tabs 97 and the associated strap or harness 99.

Returning to FIG. 1, what should now be clear is the large number of possible anchor points, combination of anchor points, and exercises made possible by the various components which secure onto different parts of the body, and such is made possible by the universal nature of the clip assembly 90. Each anchor point is established by the presence of one of the mating clips 92. In particular, at least one mating clip 92 is provided on the hand straps 50, the core harness 30, the middle arm harnesses 40, the middle leg harnesses 60, and the shin harnesses 70. This facilitates attachment of the clip receptacle 91 of one of the elastic elements 80 to any of these straps and harnesses at any of such anchor points.

Although its presence is not necessary for every embodiment of the present invention, the core harness 30 is effectively used in conjunction with many combinations of straps and harnesses. For example, with the middle arm 40 and hand straps 50 in FIG. 4; with middle leg harnesses 60 and foot harnesses 70 in FIG. 5; with just the middle leg harnesses 60 in FIGS. 8 and 9; With just a foot strap 130 in FIG. 11; and with just a thigh strap 140 in FIG. 12.

Figure 14:
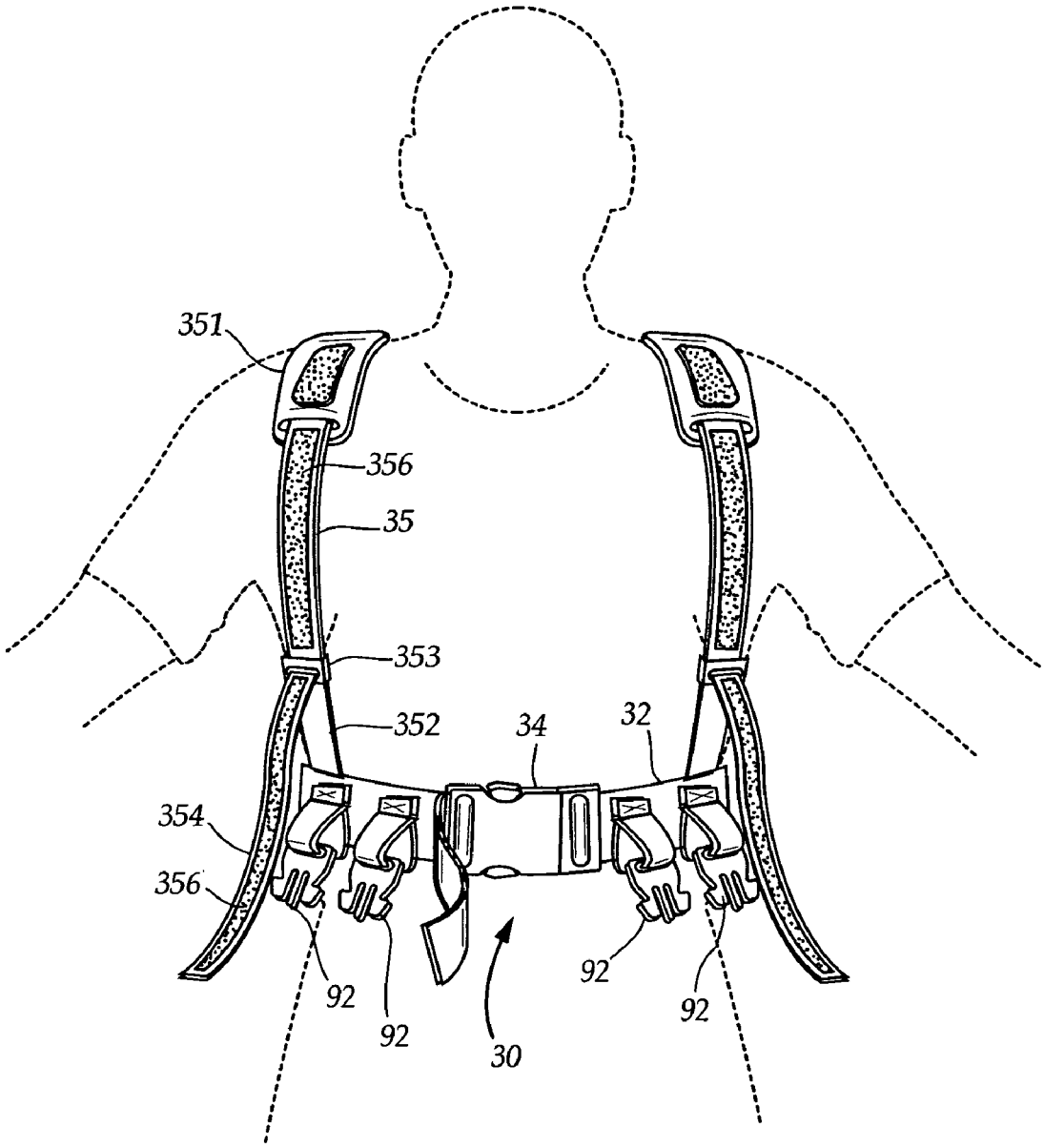
FIG. 14 is a front elevational view, illustrating an embodiment the shoulder straps of the core harness, being adjustable using hook and loop fastener material thereon.

Considering then, the core harness 30, per se, a main belt 32 extends substantially around the user 100, horizontally near the waist 114 (see FIG. 7). The main belt 32 selectively fastened and unfastened using a main buckle 34 to allow the core harness 30 to be easily fastened to the user and removed therefrom. A pair of shoulder straps 35 extend over the shoulders 117 of the user 100. Referring to FIG. 14, the core harness 30 has at least two pairs of mating clips 92 secured to the main belt 32, the pairs of mating clips 92 located on opposite sides of the main buckle 34.

Figure 15:
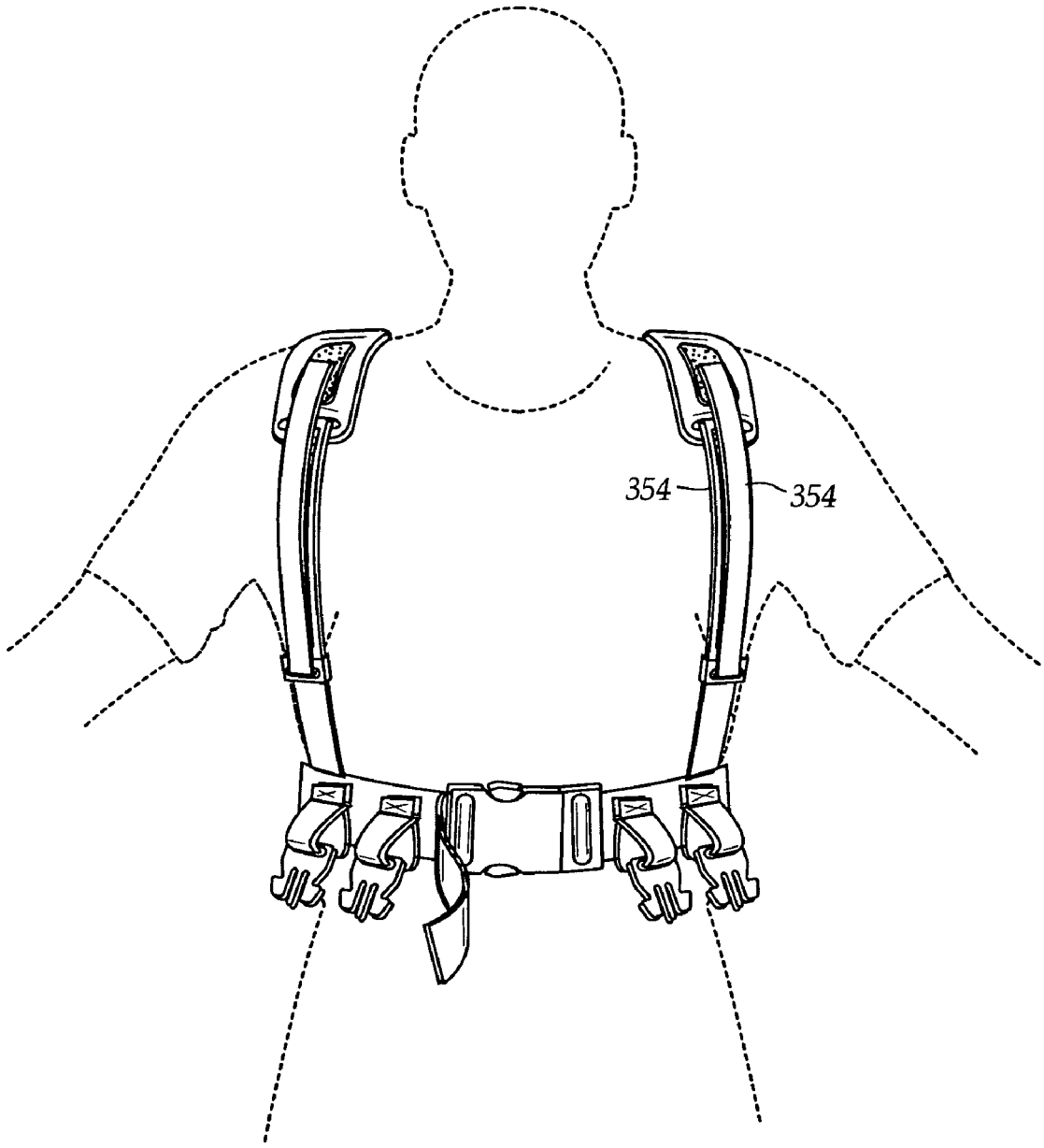
FIG. 15 is a front elevational view, similar to FIG. 14, wherein the hook and loop fastener material is secured to each other to secure the core harness to the user's body.

To facilitate adjustment and securement of the shoulder straps 35, each shoulder strap 35 has a shoulder pad 351, a lower shoulder strap 352 which is secured to the main belt 32; and shoulder buckle 353 which is secured to the lower shoulder strap 352 opposite the main belt 32; and an upper shoulder strap 354. The upper shoulder strap 354 is attached to the shoulder pad 351, extends downward to the shoulder buckle 353, extends through the shoulder buckle 353, and then reverse such that is substantially overlaps itself as it extends back towards the shoulder strap. Advantageously, the upper shoulder strap 354 has hook and loop fastener thereon 356, such that is secures to itself as it overlaps itself as illustrated in FIG. 15.

Figure 2:
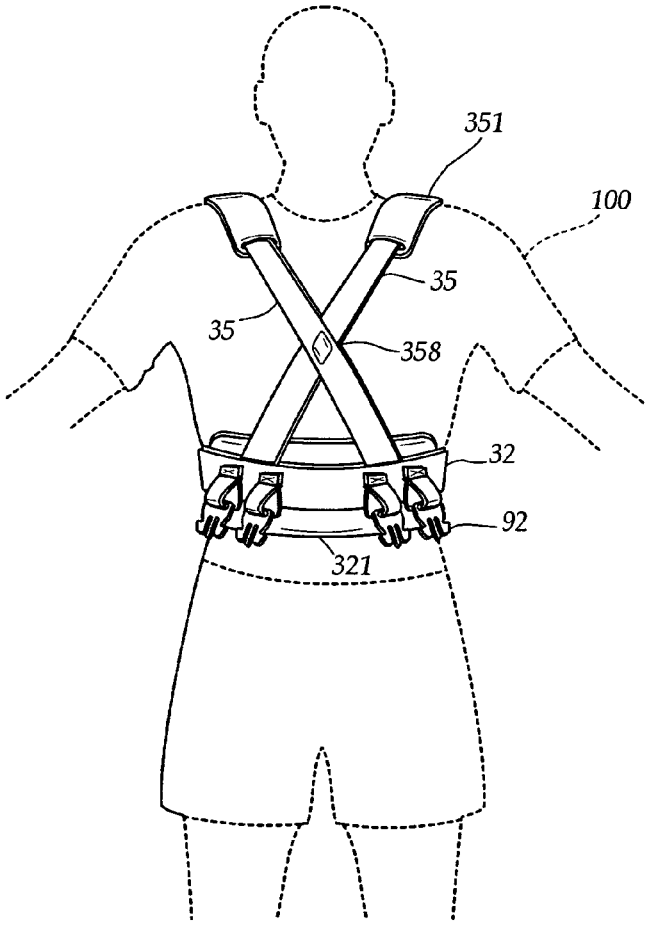
FIG. 2 is a rear elevational view, illustrating the core harness attached on the user.
Figure 3:
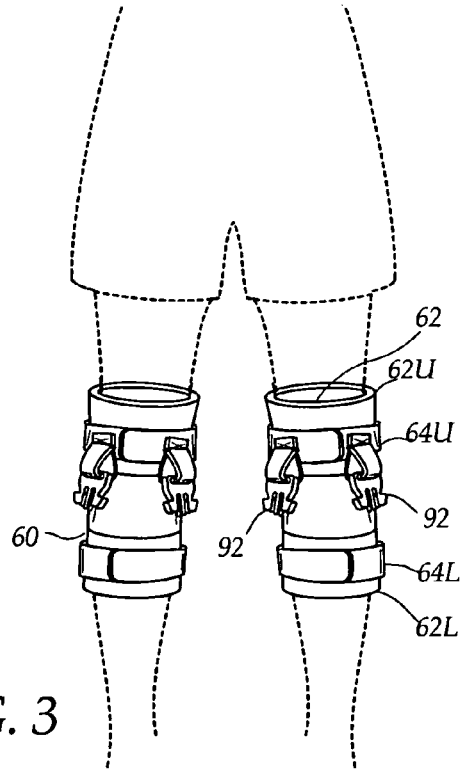
FIG. 3 is a front elevational view, illustrating a middle leg harness according to the present invention.

Referring to FIG. 2, the shoulder straps 35 preferably crisscross behind the user, and are secured together at a cross point 358, substantially midway between the shoulder pads 351 and belt 32. In addition, a lumber support 360 is 321 is preferably attached to the belt 32 behind the user 100, to help support the user's lower back region. Further, two pairs of mating clips 92 are provided on the belt 32 behind the user 100, for a total of four pairs of mating clips 92 on the belt, distributed between front and back.

Figure 8:
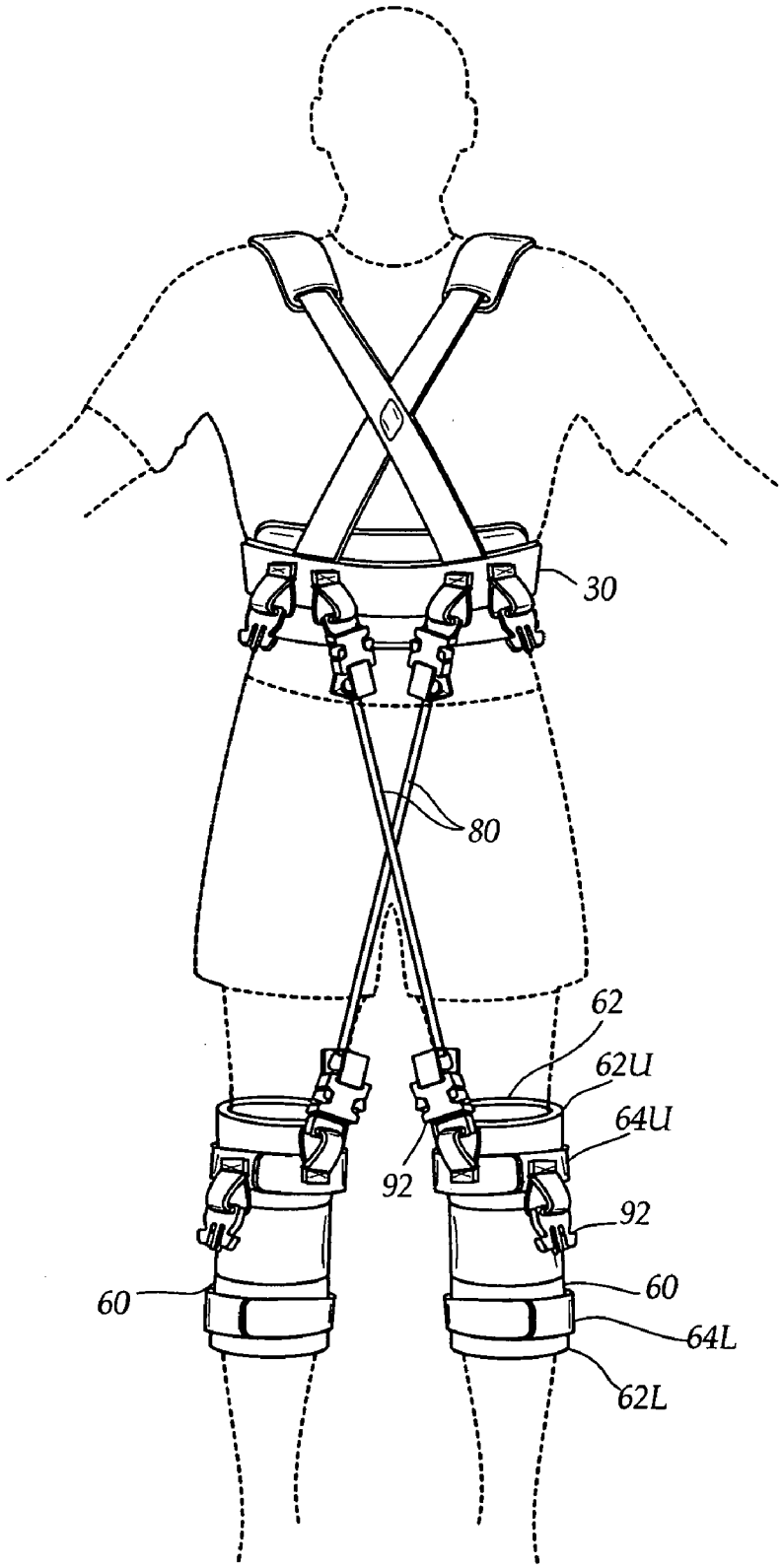
FIG. 8 is a rear elevational view, illustrating the middle leg harnesses connected to the core harness with elastic elements.
Figure 9:
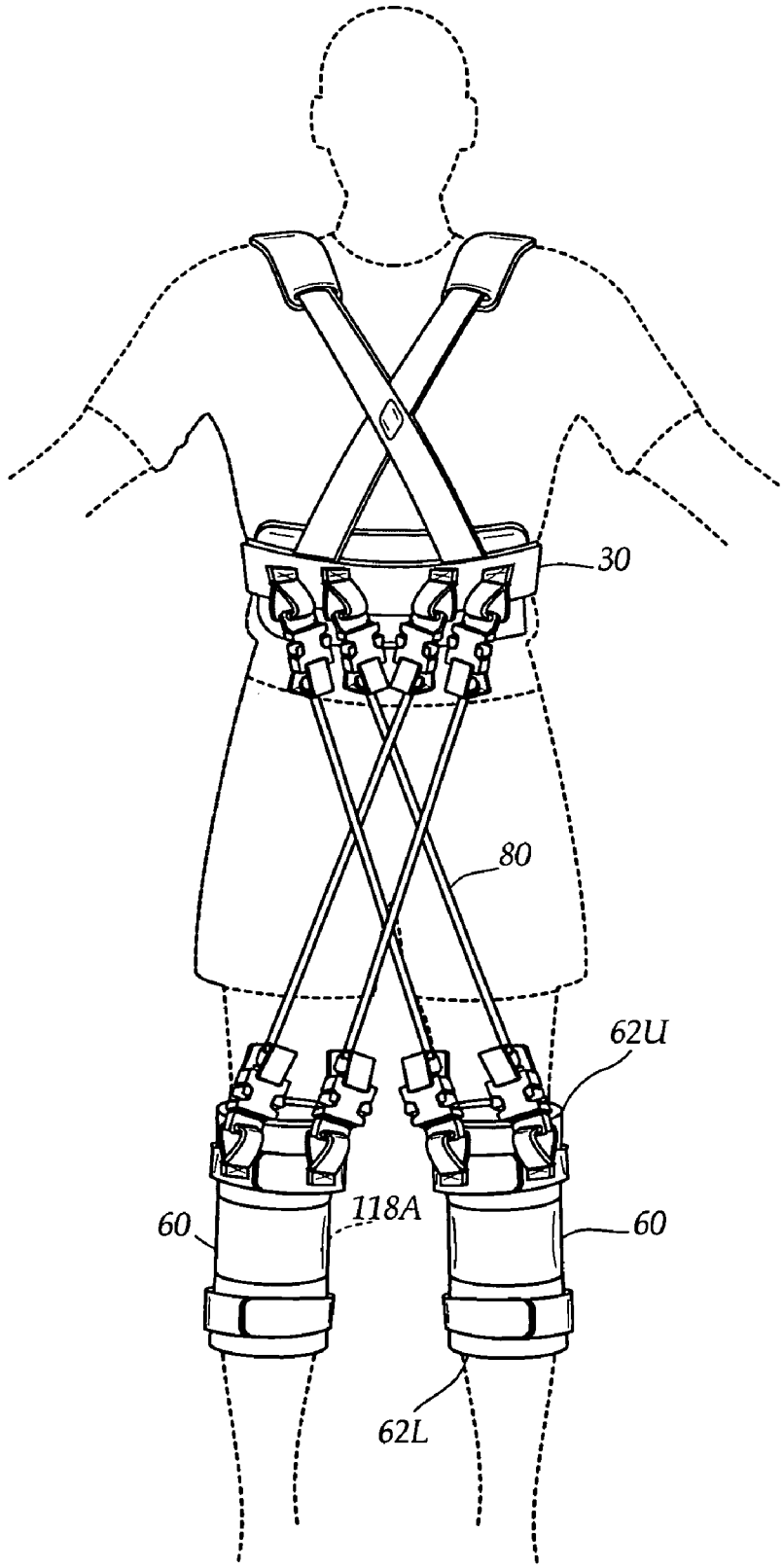
FIG. 9 is a rear elevational view, similar to FIG. 8, except wherein the middle leg harnesses are each connected to the core harness with two elastic elements.

Referring to FIGS. 8 and 9, each middle leg harness 60 has a sleeve 62 having an upper end 62U and a lower end 62L. The middle leg harness 60 also has an upper securing strap 64U and a lower securing strap 64L. The leg 118 extends through the sleeve 62 and the knee 118A is located midway between the upper end 62U and lower end 62L. Preferably, a pair of the mating clips 92 are located near the upper end 62U. As illustrated, one or two elastic elements 80 can be easily connected between each of the middle leg harnesses 60 and the core harness 30.

Figure 4:
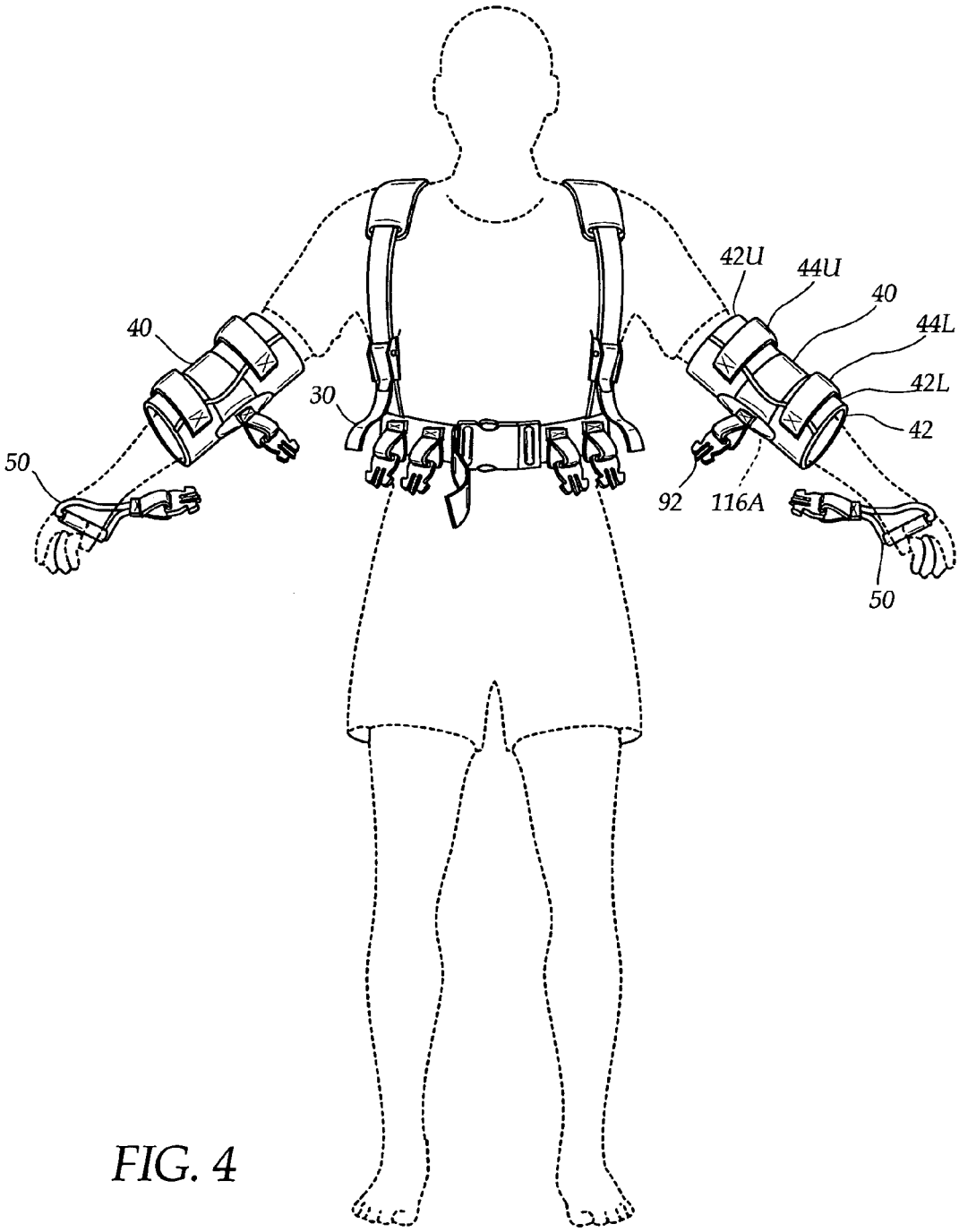
FIG. 4 is a front elevational view, illustrating the core harness attached on the user, along with a middle arm harness and a hand strap attached on each arm.

Referring to FIG. 4, each middle arm harness 40 has a sleeve 42 having an upper end 42U and a lower end 42L. The middle arm harness 40 also has an upper securing strap 44U and a lower securing strap 44L. The arm 116 extends through the sleeve 42 and the elbow 116A is located midway between the upper end 42U and lower end 42L. Preferably a mating clip 92 is located midway between the upper end and lower end.

Figure 5:
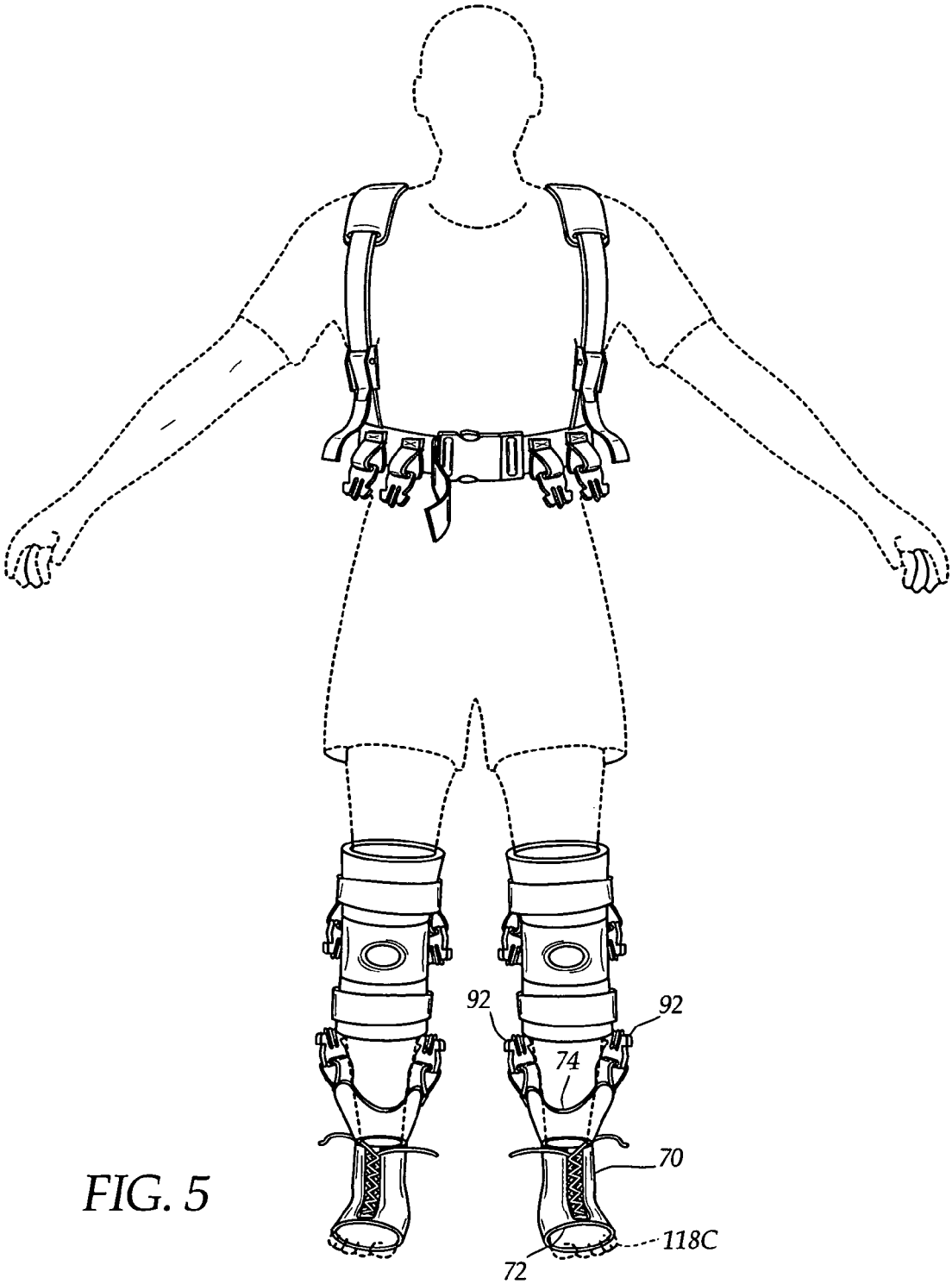
FIG. 5 is a front elevational view, illustrating the core harness, along with middle leg and shin attachments

FIG. 5 illustrates a foot harness 70, which is adapted to fit over the foot 118C. The foot harness 70 is substantially shaped like a boot to fully enclose the foot 118, but has an open bottom end 72 to allow toes to extend therethrough—making it suitable for martial arts training, and the like. The foot harness has an upper end 74. A pair of mating clips 92 are attached at the upper end of the foot harness.

Figure 10:
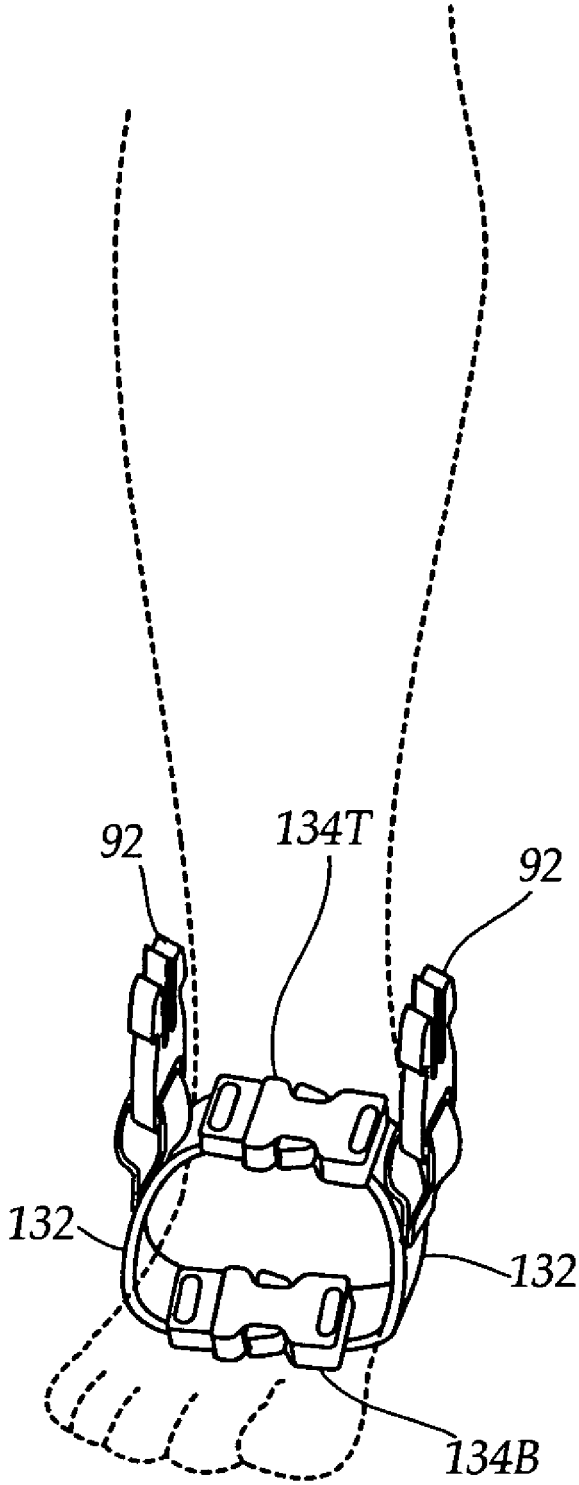
FIG. 10 illustrates a foot strap, according to the present invention.
Figure 11:
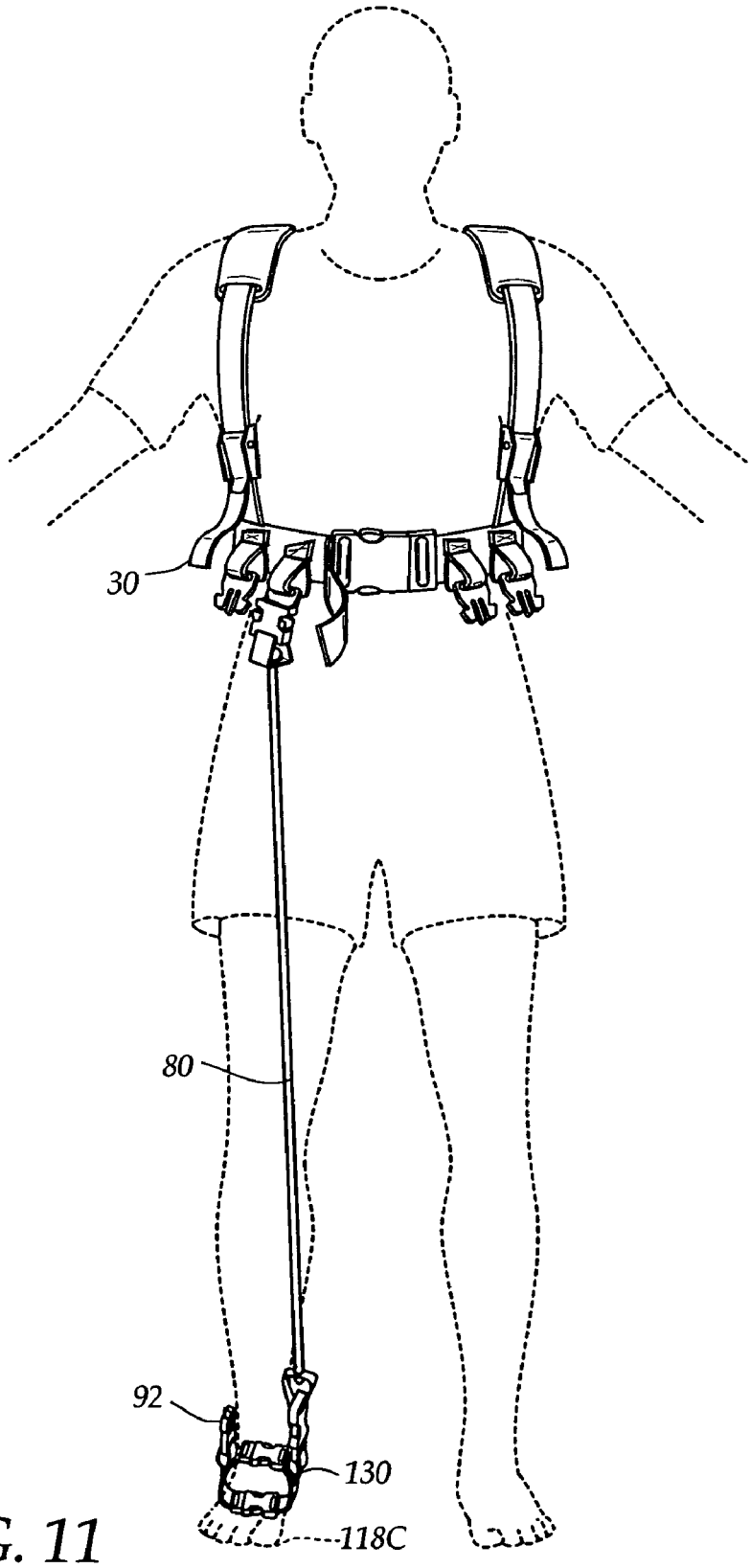
FIG. 11 illustrates the foot strap connected to the core harness with one of the elastic elements.

Referring now to FIGS. 10 and 11, the foot strap 130 has a pair of side straps 132. The side straps secured are together with a top buckle 134T and a bottom buckle 134B for encircling the foot 118C, and a pair of mating clips 92, each mating clips 92 is secured to one of the side straps midway between the top buckle and bottom buckle with an attaching band 95 that is sewed to the side straps 132. FIG. 11 illustrates the foot strap 130 linked to the core belt with a single elastic element 80. Because of the dual mating clips on the foot strap 130, clearly a pair of elastic elements could be used simulataneously.

Figure 12:
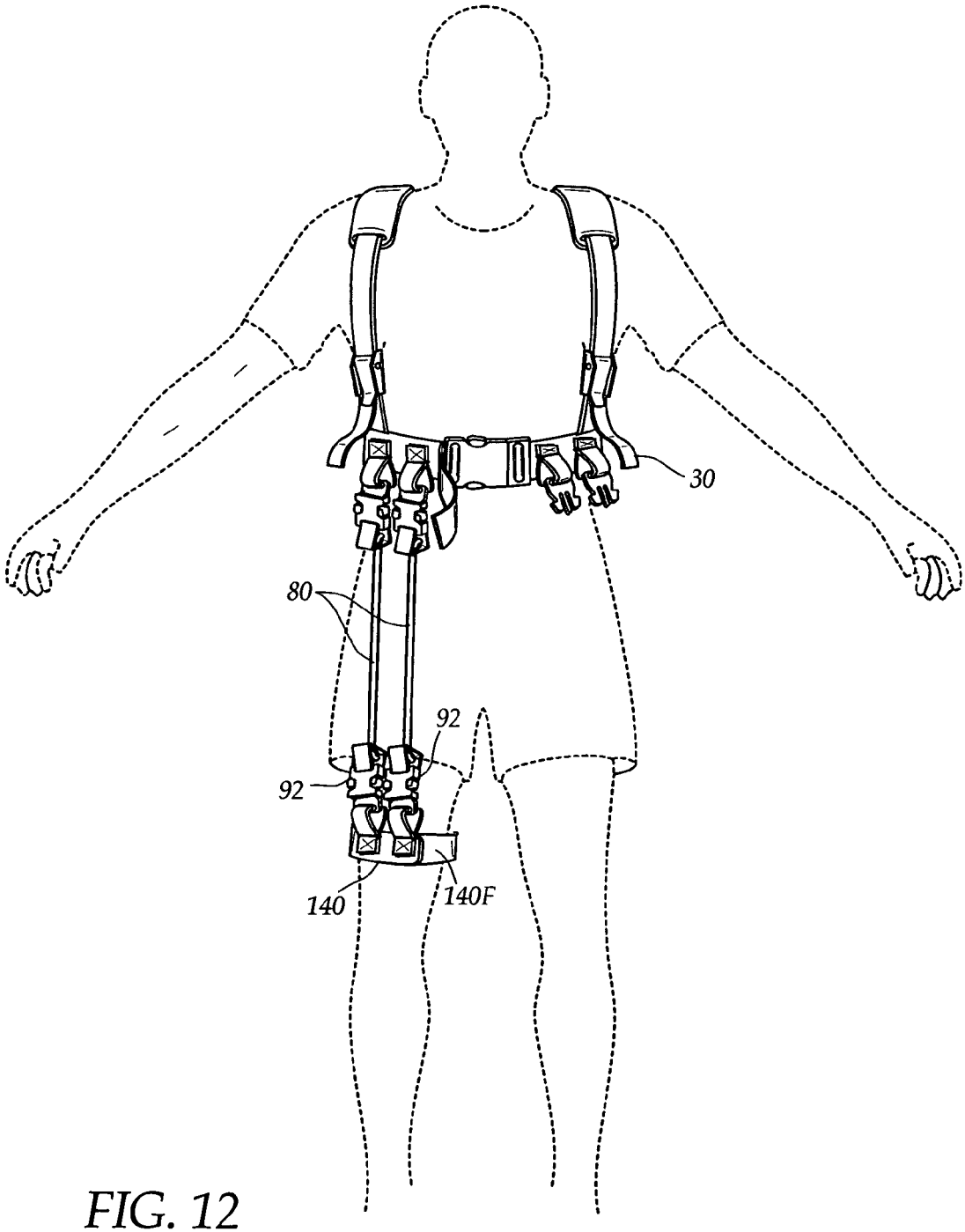
FIG. 12 illustrates a thigh strap connected to the core harness with a pair of elastic elements.
Figure 13:
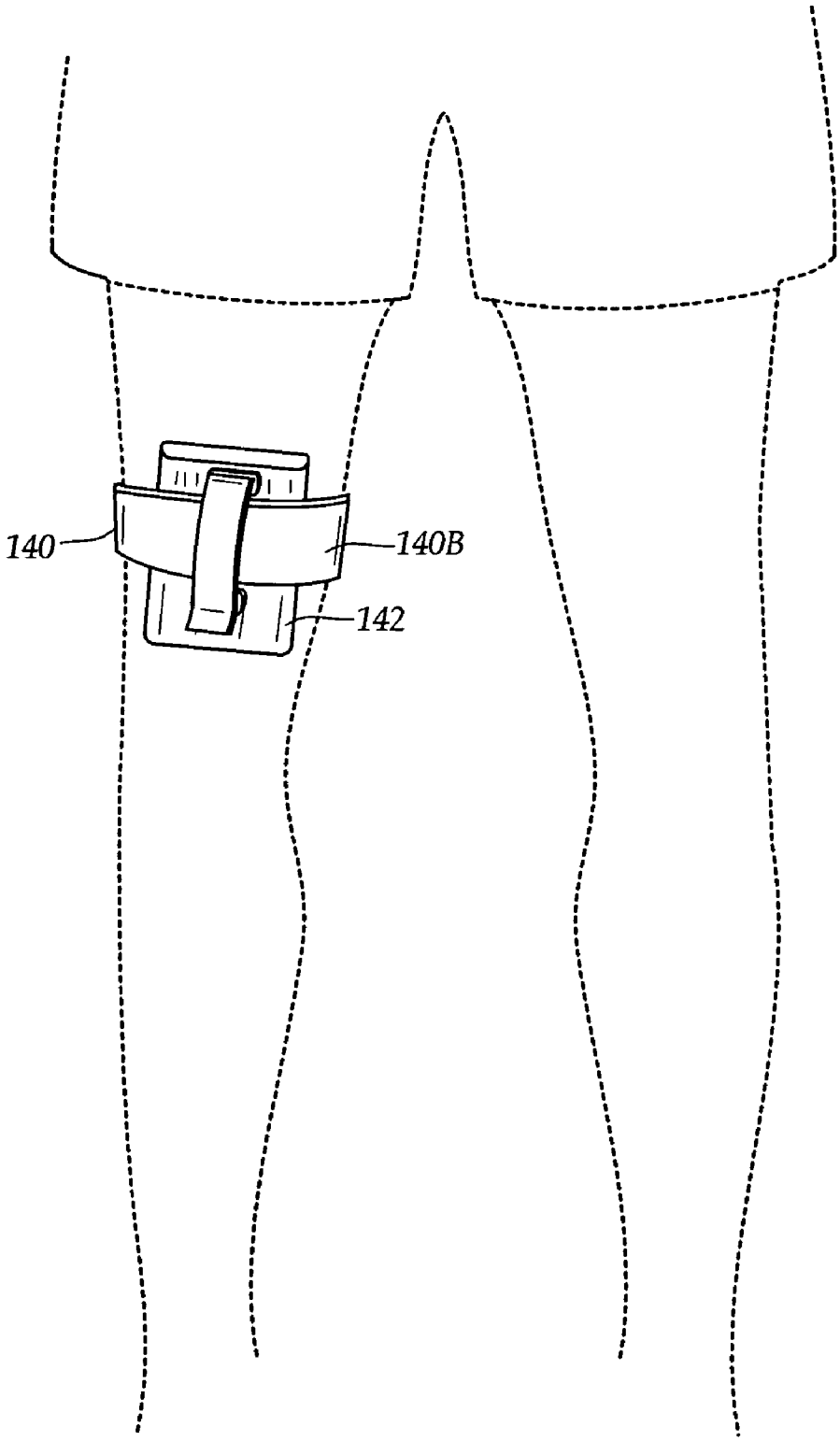
FIG. 13 is a rear view of the thigh strap, and associated thigh cushion pad.

FIGS. 12 and 13 illustrate the thigh strap 140. The thigh strap 140 has a front 140F and a back 140B. A pair of mating clips 92 are attached at the front, and a thigh cushion pad 142 is removably attached to the back 140B. In FIG. 12, a pair of elastic element 80 are secured between the thigh strap 140 and the core harness 30. The apparatus, thus configured, is useful for strengthening, rehabilitating, and training the hip flexor.

In general, the invention as described hereinabove is clearly well adaptable for a variety of strengthening, rehabilitating, and training goals. By varying the position and elastic properties of the elastic elements, different muscles can be worked, and different fitness goals—such as toning and building muscle mass can be achieved. Providing such variations is well within the purview of those skilled in the art. Accordingly, no further discussion herein is necessary. In a similar regard, variations in the harnesses themselves may be conceived and created, while adhering to the inventive concept.

In conclusion, herein is presented an exercise device for strengthening, training, and rehabilitating muscle groups using interchangeable and interconnectable elastic elements. The invention is illustrated by example in the drawing figures, and throughout the written description. It should be understood that numerous variations are possible, while adhering to the inventive concept. Such variations are contemplated as being a part of the present invention.

What is claimed is:

1. An exercise device, for use by a user, having a body, for strengthening, training, and rehabilitating the body, comprising:

at least two harnesses, each harness for attaching to the body and each having a mating clip secured to said harness, defining and anchor point thereat;

an elastic element, having an elastic cord, and a pair of clip receptacles secured to the elastic cord, each clip receptacle for securing to one of the mating clips at said anchor points such that the elastic element resists movement of the body between said anchor points, wherein the clip receptacle had an end slot, a main opening, and a pair of side openings, the elastic element has a connecting loop that extends through the end slot of the clip receptacle and has a base which is fully opposite from the end slot and sides therebetween, a grommet is mounted to the base and a circular hole extends through both the grommet and the base, the elastic cord extends through the circular hole and has an enlargement adjacent the circular hole and within the connecting loop, the enlargement prevents the elastic cord from being pulled through the circular hole and thus attaches the elastic cord to the connecting loop and thus to the clip receptacle; and wherein the mating clip has a pair of side members that extend substantially parallel and have a pair of hooks that extend outwardly from the side members, a space is located between the side members for allowing them to flex inwardly toward each other, to insert the mating clip into the clip receptacle the side members must be flexed inwardly toward each other in order to be inserted into the main opening of the clip receptacle, once the side members are fully inserted into the main opening, the side members flex outwardly so that the hooks extend through and engage the side openings of the clip receptacle and prevent the clip receptacle mating hook from being pulled apart.

2. The exercise device recited in claim 1, wherein the body includes shoulders and a waist, and wherein the at least two harnesses further comprise a core harness, the core harness having a main belt for extending around the waist, a pair of shoulder straps for extending from the belt and over the shoulders, the shoulder straps are criss-crossed behind the user and are secured together at a cross point, the belt has four pairs of mating clips secured thereto.

3. The exercise device as recited in claim 2, wherein the shoulder straps include shoulder pads, a shoulder strap buckle, a lower shoulder strap that extends between the belt and buckle, an upper shoulder strap that is extends downwardly from the shoulder pad to the buckle, reverses at the buckle and overlaps itself as it extends upwardly from the buckle toward the shoulder pad, the upper shoulder strap has a hook and loop material thereon so that it can secure to itself as it overlaps itself.

4. The exercise device as recited in claim 3, wherein the harness other than the core harness has at least two mating clips.

5. The exercise device as recited in claim 3, wherein the harness other than the core harness is selected from the group consisting of the middle arm harness, middle leg harness, foot harness, foot strap, hand strap, and thigh strap.

6. The exercise device as recited in claim 3, wherein the body includes a foot; and wherein the harness other than the core harness is a foot strap, and said foot strap having a pair of side straps, the side straps secured together with a top buckle and a bottom buckle for encircling the foot, and a pair of mating clips, each mating clip is secured to one of the side straps midway between the top buckle and bottom buckle.

7. The exercise device as recited in claim 3, wherein the harness other than the core harness is selected from the group consisting of a middle arm harness and a middle leg harness, said harness comprising a sleeve, and an upper and lower securing belt.

8. The exercise device as recited in claim 3, wherein the harness other than the core harness is a middle arm harness, having an upper end, lower end, and upper securing belt and a lower securing belt, and having a mating clip secured to the sleeve midway between the upper and lower end.

9. The exercise device as recited in claim 3, wherein the harness other than the core harness is a middle leg harness, having an upper end, lower end, and upper securing belt and a lower securing belt, having a pair of mating clips located near the upper end.

10. The exercise device as recited in claim 3, wherein the harness other than the core harness is a thigh strap, having a front and back, a pair of mating clips are attached at the front, and a cushion pad is removable attached to the back.

11. The exercise device as recited in claim 3, wherein the body has a foot having toes, and further comprising a foot harness, the foot harness substantially shaped like a boot for fully enclosing the foot except having an open bottom end for allowing the toes to extend therethrough, the foot harness having an upper end, and having a pair of mating clips secure to the upper end.

* * * * *